United States Patent [19]

Vega

[11] 4,313,589

[45] Feb. 2, 1982

[54] READING DESK

[76] Inventor: Adrian S. Vega, Sol St. No. 82, Guayama, P.R.

[21] Appl. No.: 101,512

[22] Filed: Dec. 7, 1979

[51] Int. Cl.[3] ..... A47B 23/00

[52] U.S. Cl. ..... 248/558; 248/441 A; 248/445; 248/460

[58] Field of Search ..... 248/441 A, 445, 449, 248/451, 454, 460, 558

[56] References Cited

U.S. PATENT DOCUMENTS

| | | | |
|---|---|---|---|
| 816,507 | 3/1906 | Smering | 248/449 |
| 1,179,536 | 4/1916 | Lyman | 248/558 X |
| 2,474,725 | 6/1949 | Clark | 248/558 X |
| 2,546,283 | 3/1951 | Webster | 248/445 X |
| 3,312,440 | 4/1967 | Zelony | 248/558 X |
| 3,476,348 | 11/1969 | Rustad | 248/445 |
| 3,664,629 | 5/1972 | Reed | 248/445 |
| 3,740,015 | 6/1973 | Adams | 248/445 |
| 3,747,889 | 7/1973 | Gerald | 248/451 |

FOREIGN PATENT DOCUMENTS

| | | | |
|---|---|---|---|
| 1381731 | 1/1975 | United Kingdom | 248/454 |

*Primary Examiner*—William H. Schultz

*Attorney, Agent, or Firm*—Scrivener, Clarke, Scrivener and Johnson

[57] ABSTRACT

The disclosure is of a desk for supporting material being read by a person who is in a seated or reclining position.

2 Claims, 5 Drawing Figures

READING DESK

SUMMARY OF THE INVENTION

The reading desk provided by the invention comprises an inclined transparent plate providing a flat surface for supporting any reading matter, this surface being supported in its inclined position by a base part. Means for supporting the reading material on the inclined surface are provided, and in one form of the invention means are provided for adjusting the angle of inclination of the surface which supports the material being read.

DESCRIPTION OF THE INVENTION

Figure 1:
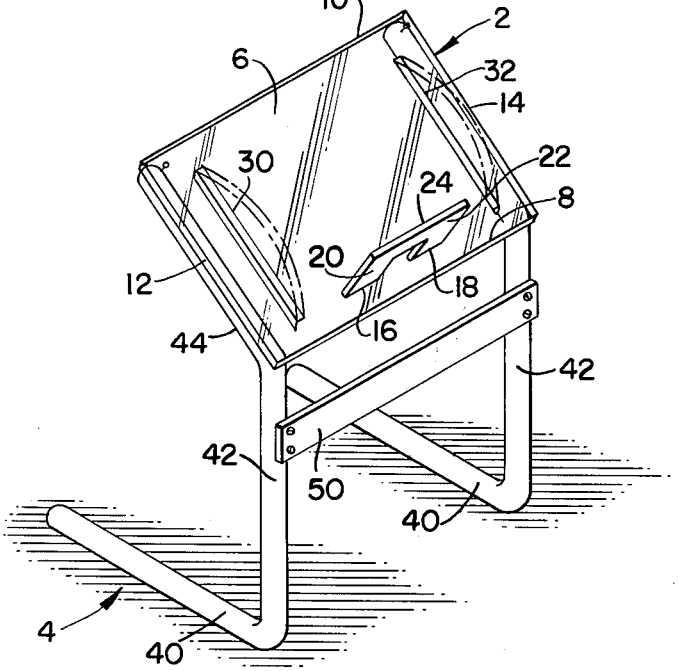
FIG. 1 is a perspective view of the reading desk.
Figure 2:
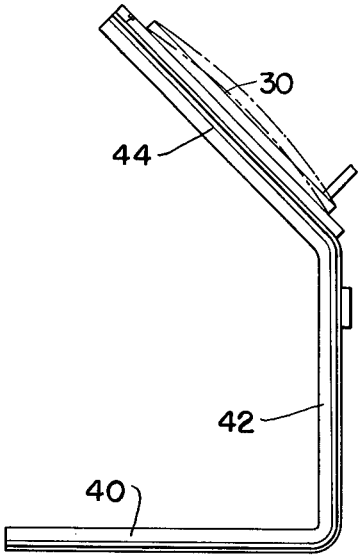
FIG. 2 is a side view.
Figure 3:
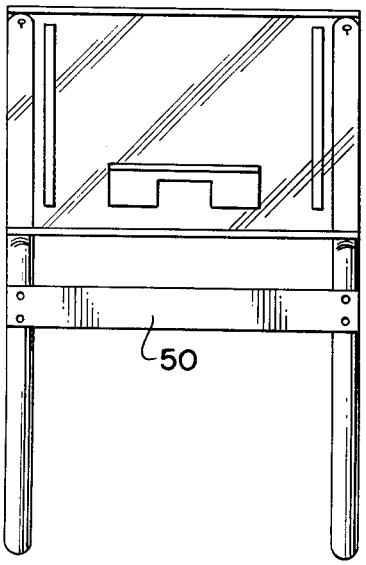
FIG. 3 is a front view.

A preferred form of the reading desk which I have invented is disclosed in FIGS. 1, 2 and 3 of the drawings and comprises basically a flat transparent member 2 for holding a book, magazine or other reading matter, and a supporting base 4, the parts being so constructed and arranged that the supporting member is in an inclined position with respect to an underlying surface such as the floor or the upper surface of a bed.

The member for supporting the reading matter comprises a flat transparent plate 6 which is preferably rectangular in shape having front and rear edges 8, 10 and side edges 12, 14. Adjacent its front edge 8, which is the lower edge of the desk, there are transversely spaced narrow openings or slits 16, 18 which provide means for receiving the depending flat legs 20, 22 of an upstanding flat member 24 which when installed provides a stop for the lower edge of the reading matter placed on the upper surface of the book-supporting member 2. Along and inward of its side edges 12, 14 there are provided means for holding the side edges of the reading material placed on the upper surface of plate 2, and these means may take the form of elastic straps 30, 32 each of which is connected at its ends to the plate 2.

Means are provided for supporting the plate 2 in its inclined position with respect to a basic supporting surface such as the floor or the upper surface of a bed. These means comprise a frame having two substantially identical legs each of which is a formed or a bent tube of rigid material such as stainless steel. These two legs are positioned below the supporting surface 2 and below the opposite side edges 12, 14 thereof and are identical in construction. Each of the two supporting legs comprises a lower part 40 which is horizontal in the normal position of use of the desk, an upstanding vertical part 42 at the forward end of the part 40, and an upwardly inclined part 44 which extends at obtuse angle from the vertical part 40 and is positioned above the lower part 40 and in the same plane as parts 40 and 42. The upper part 44 of each leg lies under the side edge 12 or 14 of the plate 2 and is connected to the plate by any suitable means. A bracing member 50 extends transversely and horizontally between the vertical parts 42 of the two legs and provides stability to the entire desk.

Figure 4:
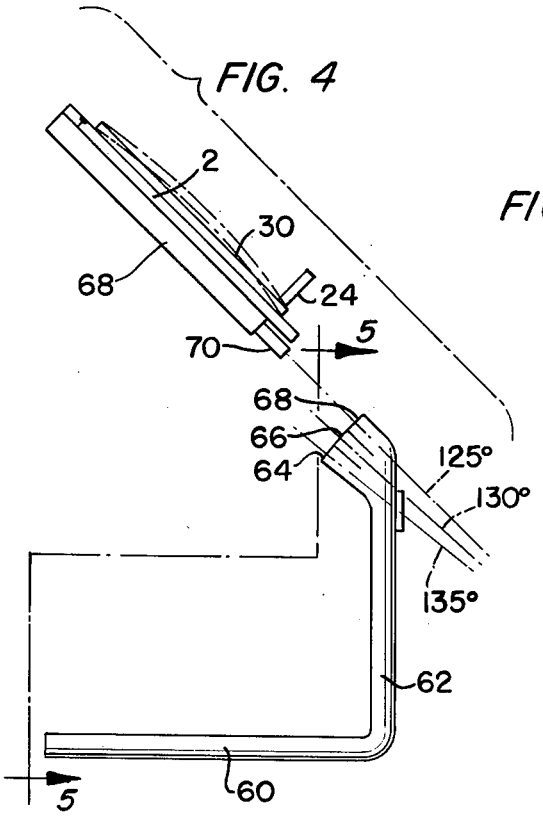
FIG. 4 is an exploded side view of a modified form of the invention.
Figure 5:
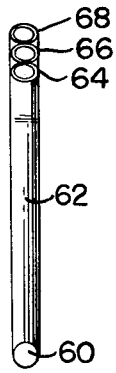
FIG. 5 is a view taken on line 5—5 of FIG. 4.

A modified form of the invention is disclosed in FIGS. 4 and 5 of the drawings and provides means for adjusting the angle of inclination of the supporting surface 2 on which the book or other reading matter is supported. In this form of the invention the book supporting member 2 and the supporting legs for that member are separate but may be connected. The supporting structure for the plate 2 comprises two legs each of which has a lower horizontal part 60 and an upwardly extending vertical part 62 which extends upwardly from the forward end of part 60. At its upper end the part 62 is provided with a plurality, preferably 3, of sockets which are indicated at 64, 66, 68 and which are positioned in a vertical line as shown in FIG. 5. These sockets are positioned above and in the same vertical plane as the parts 60, 62 of each supporting leg and they are angularly and upwardly directed at different obtuse angles to a vertical as clearly shown in FIG. 4. The book supporting member 2 has connected thereto along each of its side edges a tubular member 68 which terminates at its one end in a tubular member 70 which is of such length and diameter that it may be received in any one of the sockets 64, 66, 68. It will be seen that by placing the member 70 in one or another of the sockets the angular relation of the book supporting surface 2 may be changed with respect to the underlying horizontal surface, such as the floor or the upper surface of a bed.

The reading desk may be used in a variety of ways, in part because of the fact that the plate which supports the reading matter is transparent. Thus, the user or reader may sit at the desk when it is supported on the floor or on any raised surface such as a table top, and when used in this way the reading matter on the inclined plate 2 will be positioned with the reading matter upward. Also, the desk may be used while the reader is in a recumbent position, such as when he or she is lying in bed, and in this case the reading matter will be placed in contact with the transparent supporting surface and read through it.

I claim:

1. A reading desk comprising a plate for supporting reading matter on its upper surface, and supporting means for the plate, (a) the plate being formed of transparent material, and having parallel front and rear edges and parallel side edges, transversely extending and aligned slits in the plate adjacent its front edge, a stop member having transversely and downwardly extending aligned flat legs received in the slits and extending upwardly from the plate to provide a stop, and two elongated elastic members each adjacent one of the side edges and connected at its ends to the plate to provide a hold-down for reading matter on the plate, and (b) means for supporting the plate in inclined position, comprising two tubular members each positioned under and connected to a side edge of the plate and having a lower part adapted to be in horizontal position in the normal use of the desk, a part which is vertical in such normal use, and a part disposed at an obtuse angle to the vertical part and which underlies and is connected to a side edge of the plate.

2. The reading desk according to claim 1, in which the plate and the support for the plate are separate, the vertical part of the support having at the upper end thereof three sockets which are inclined upwardly at different angles, the plate having means thereon constructed and adapted to be selectively received in any one of the sockets thereby to adjust the inclination of the plate.

* * * * *